United States Patent [19]

Nishida

[11] Patent Number: 4,651,683

[45] Date of Patent: Mar. 24, 1987

[54] INTERNAL COMBUSTION ENGINE WITH APPARATUS RESPONSIVE TO SHORTAGE OF COOLANT

[75] Inventor: Hiroshi Nishida, Miki, Japan

[73] Assignee: Kawasaki Jukogyo Kabushiki Kaisha, Kobe, Japan

[21] Appl. No.: 762,552

[22] Filed: Aug. 5, 1985

[30] Foreign Application Priority Data

Aug. 8, 1984 [JP] Japan ..... 59-121764[U]

[51] Int. Cl.[4] ..... F01P 11/16

[52] U.S. Cl. ..... 123/41.15; 123/568; 123/198 D; 137/505.14; 236/86; 251/11

[58] Field of Search ..... 123/41.15, 198 D, 407, 123/568, 569; 137/505, 505.14, 595, 596.18, 627.5, DIG. 8; 236/86, 101 C; 251/11

[56] References Cited

U.S. PATENT DOCUMENTS

| | | | |
|---|---|---|---|
| 2,877,701 | 3/1959 | Whitaker | 123/568 X |
| 4,126,114 | 11/1978 | Davis | 123/41.15 X |
| 4,142,496 | 3/1979 | Saito et al. | 123/568 |
| 4,208,994 | 6/1980 | Kitamura | 123/568 |
| 4,303,195 | 12/1981 | Hashimoto et al. | 123/568 |
| 4,485,781 | 12/1984 | Barnes | 123/198 D X |
| 4,540,153 | 9/1985 | Gomi et al. | 123/568 X |

FOREIGN PATENT DOCUMENTS

| | | | |
|---|---|---|---|
| 0193716 | 11/1982 | Japan | 123/41.15 |

*Primary Examiner*—Willis R. Wolfe, Jr.

*Attorney, Agent, or Firm*—Marshall, O'Toole, Gerstein, Murray & Bicknell

[57] ABSTRACT

This disclosure relates to a water-cooled engine for a boat, including apparatus to prevent the engine from overheating due to a shortage of coolant. The apparatus includes an air intake connected to supply fresh air to the engine, and an exhaust system connected to discharge exhaust gas from the engine. A duct is connected between the air intake and the exhaust system, and a normally closed valve is provided in the duct. A heat responsive device is provided on the engine to open the valve in response to a predetermined high temperature of the engine, whereby at least a portion of the exhaust gas is fed back through the duct to the air intake.

12 Claims, 3 Drawing Figures

INTERNAL COMBUSTION ENGINE WITH APPARATUS RESPONSIVE TO SHORTAGE OF COOLANT

FIELD AND BACKGROUND OF THE INVENTION

The present invention relates to a water-cooled internal combustion engine, and more particularly to such an engine of the type used in a boat or other water craft.

A conventional water craft has a water jet type propulsion system with a water-cooled engine. The engine cooling water is sucked into the engine room from the outside of the craft through a coolant pipe, and the coolant pipe often sucks in floating debris such as pieces of nylon or vinyl sheets which block the pipe. The operator may continue operating the craft without knowing of the stoppage of coolant flow, with the result that the engine may overheat and be damaged.

It is a general object of this invention to provide an apparatus which responds to a shortage of coolant flow to an engine of this type, and protects the engine from damage.

SUMMARY OF THE INVENTION

Apparatus according to this invention includes air intake means connected to supply fresh air to the engine, and an exhaust system connected to discharge exhaust gas from the engine. Duct means is connected between the air intake means and the exhaust system, and a normally closed valve is provided in the duct means. Heat responsive means is provided on the engine to open the valve in response to a predetermined high temperature of the engine, whereby at least a portion of the exhaust gas is fed back through the duct means to the intake means.

BRIEF DESCRIPTION OF THE DRAWINGS

The foregoing and other objects and advantages of the invention will be apparent from the following detailed description taken in conjunction with the accompanying drawings, wherein.

DETAILED DESCRIPTION OF THE DRAWINGS

Figure 1:
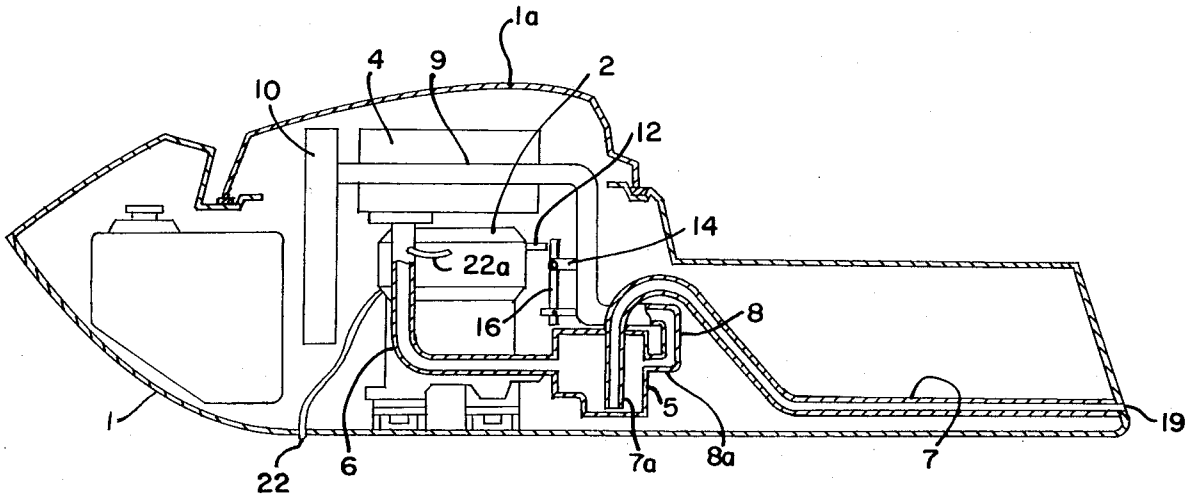
FIG. 1 is a side view partially in cross section of a water jet propulsion type boat according to a first embodiment of the invention.

In FIG. 1, the boat according to the first embodiment includes a hull 1 and a cover 1*a* which form an enclosed engine compartment. A water-cooled engine 2 is mounted within the compartment. The engine 2 includes a conventional cylinder exhaust port (not shown) connected to a conventional exhaust manifold (not shown) and to a muffler 4, which is connected in turn to an upstream exhaust duct 6. The duct 6 is connected in turn to a water box 5 which retains the water content in the exhaust gas from the engine as will be explained.

A downstream exhaust duct 7 has one end 7*a* which opens in the water box 5 adjacent the bottom of the box, or below the end of the upstream duct 6 which is connected to the box 5. The downstream duct 7 extends upwardly from the end 7*a*, through the upper wall of the box 5, rearwardly of the boat, and opens at its outer end in the discharge port 19 formed through the hull 1 at the stern.

A branch exhaust duct 8 has one end 8*a* which opens into the water box 5 above the inner end 7*a* of the downstream duct 7. The branch duct 8 is connected through a connecting pipe 9 (FIGS. 1 and 2) to an air intake duct 10, which extends from the vicinity of the engine 2 to the outside of the hull 1 through an opening in the cover 1*a*. The air intake duct 10 extends through a hole in the cover and normally conveys fresh air into the engine compartment to a location adjacent the air intake of the engine.

Figure 2:
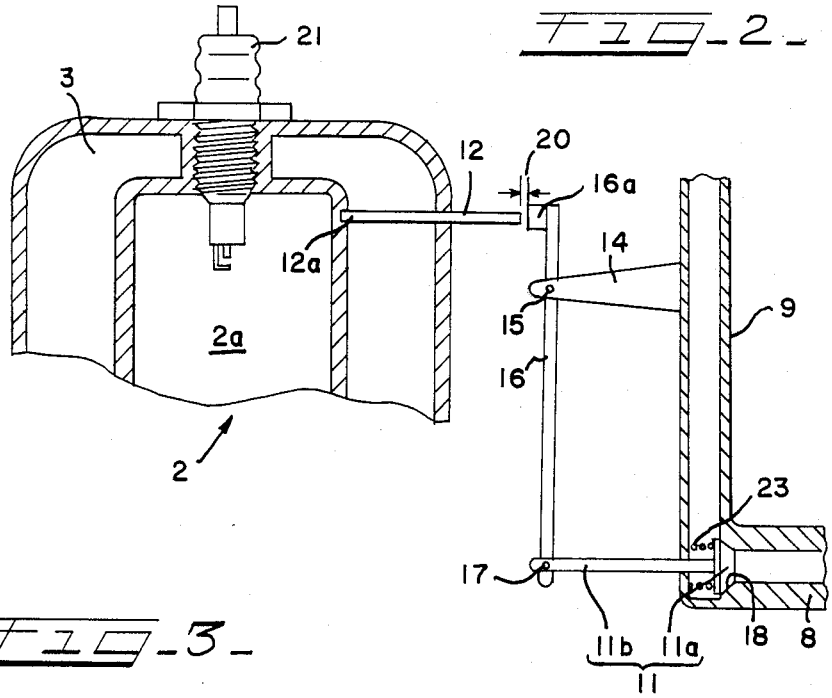
FIG. 2 is an enlarged fragmentary view in cross section of part of the boat shown in FIG. 1.

As shown in FIG. 2, the cylinder 2*a* of the engine 2 is surrounded by a water jacket 3 which is connected to a coolant water intake tube 22 (FIG. 1) extending through a hole in the bottom of the hull 1. Water is sucked in through the tube 22, circulated through the jacket 3, and discharged through a tube 22*a* (FIG. 1) into the exhaust duct 6. The water mixes with the exhaust and flows to the water box 5 where it is temporarily retained.

The water jacket 3 has a bar-like heat sensitive member 12 extending through the wall thereof, a portion of the member 12 projecting out from the jacket 3. A rod 16 is pivotally supported at approximately its intermediate point by a pin 15 on a bracket 14 which is fixed to the pipe 9 and is therefore stationary relative to the hull 1. The lower end of the rod 16 is pivotally connected by a pin 17 to a rod 11*b* of a valve 11 (FIG. 2), and the valve rod 11*b* of the valve 11 slidably extends through a side wall of the connecting pipe 9. The body 11*a* of the valve 11 is urged by a spring 23 to nornmally engage a valve seat 18, which is formed in the outlet end of the branch exhaust duct 8. The upper end of the rod 16 has a block 16*a* fixed thereto, the block 16*a* being in line with the heat sensitive member 12. A predetermined gap 20 exists between the block 16*a* and the member 12 during the normal operation of the engine.

The heat sensitive member 12 may be made of aluminum or some other material which has a high heat conductivity, a high coefficient of linear expansion and a high fusion temperature.

In normal engine operation the valve 11 is closed and blocks any flow through the ducts 8 and 9. Normally with the valve 11 closed, the water in the water box 5 has its surface at the level of the inner end 7*a* of the downstream exhaust duct 7. Water normally circulates through the tubes 22 and 22*a*, the water jacket 3, and the duct 6 to the box 5. When the water level rises above the end 7*a* of the duct 7, the exhaust gas pressure in the box 5 causes any excessive amount of the water to be discharged through the duct 7 along with the exhaust gas from the upstream duct 6.

If the water intake tube 22 becomes blocked by a foreign body, the coolant flow stops with the result that the temperature within the engine water jacket 3 quickly rises to the order of 300° C. This excessive temperature causes the heat sensitive member 12 to expand lengthwise. The interior end 12*a* of the member 12 abuts a wall of the engine and therefore the member 12 cannot expand inwardly. The outer end of the member 12 therefore expands toward the right and pushes the block 20. The rod 16 pivots clockwise and opens the valve body 11*a* away from the seat 18.

Because of the resistance to the exhaust gas flow through the duct 7 caused by the water in the box 5 around the end 7*a*, the gas then flows through the branch duct 8, the now open valve 11, the connecting pipe 9 and into the air intake duct 10. As a result, the exhaust gas enters the engine compartment and the engine air intake, and the engine operation becomes very poor due to the shortage of oxygen. This can be noticed by the operator who should then stop and clear the water intake, or the engine will automatically stop.

Figure 3:
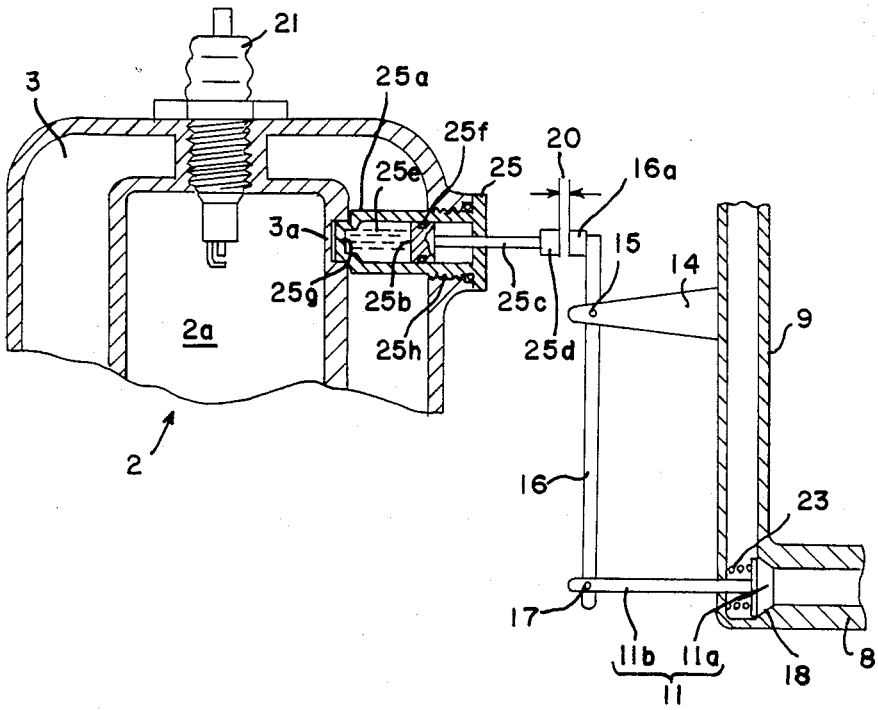
FIG. 3 is a view similar to FIG. 2, but showing a second embodiment of the invention.

In the embodiment shown in FIG. 3, corresponding parts are given the same reference numerals as in FIG. 2.

A heat sensitive unit 25 includes a cylinder 25*a* having an outer threaded part 25*h*, which engages a threaded hole in the outer wall of the engine 2. The cylinder 25*a* extends into the water jacket 3. The cylinder 25*a* has an inner end 25*g* of a reduced diameter which is in engagement with a recess 3*a* in the inner wall of the jacket 3.

A piston 25*b* is slidable within the cylinder 25*a*, and has an O-ring seal 25*f*. The piston has a piston rod 25*c* with a block 25*d* fixed to its outer end. The block 25*d* is aligned with the block 16*a* of the rod 16, and the blocks are normally spaced apart by a distance 20.

The cylinder 25*a* contains a heat sensitive fluid 25*e* adjacent the inner end 25*g*. This fluid is liquid at a normal temperature of 70°–80° C. during the normal engine operation, and vaporous at a higher or excessive engine temperature. The fluid may be water (boiling point: 100° C.) or turpentine oil (boiling point: 160° C.). Instead, the fluid may be a liquid having a high coefficient of cubical expansion, such as glycerol and paraffin oil.

The heat sensitive unit 25 operates by the expansion of the fluid 25*e* similarly to the sensor 12 in FIG. 2. The expanded fluid pushes the piston 25*b* outwardly and opens the valve 11, thereby causing the engine to falter or stop as previously described.

What is claimed is:

1. Apparatus for preventing an internal combustion engine from overheating, the engine including an engine air intake and an engine exhaust, said apparatus comprising air intake means connected to supply fresh air to said engine air intake, an exhaust system adapted to be connected to said exhaust and to discharge exhaust gas from said engine, duct means connected between said air intake means and exhaust system, a normally closed valve mounted in said duct means, and heat responsive means adapted to be mounted on said engine and to respond to a predetermined excessively high temperature of said engine, said heat responsive means being operatively coupled to open said valve at said high temperature, whereby at least a portion of the exhaust gas is fed back from said exhaust system, through said duct means to said air intake means, and a water jacket provided on said engine to circulate coolant therethrough, said heat responsive means extending into said jacket, said heat responsive means comprising a member normally spaced from said valve and said member being operable to compressively engage and open said valve at said high temperature.

2. An engine including apparatus for preventing the engine from overheating, said engine comprising an engine air intake, an engine exhaust, air intake means connected to supply fresh air to said engine air intake, an exhaust system connected to said exhaust and to discharge exhaust gas from said engine, duct means connected between said air intake means and exhaust system, a normally closed valve mounted in said duct means, and heat responsive means mounted on said engine and responsive to a predetermined excessively high temperature of said engine, said heat responsive means being operatively coupled to open said valve at said high temperature, whereby at least a portion of the exhaust gas is fed back from said exhaust system, through said duct means to said air intake means, and a water jacket for circulating coolant therethrough, said heat responsive means extending into said jacket, said heat responsive means comprising a member normally spaced from said valve and said member being operable to compressively engage and open said valve at said high temperature.

3. A boat comprising a hull, said hull forming an enclosed engine compartment, a water-cooled internal combustion engine mounted in said compartment, an air intake means for supplying fresh air to said engine, an exhaust system connected to said engine and extending out of said compartment to discharge exhaust gas from said engine, duct means connected between said exhaust system and adjacent said air intake means, a normally closed valve provided in said duct means, and heat responsive means provided on said engine and connected to open said valve in response to a predetermined excessively high temperature of said engine, whereby at least a portion of the gas is fed back through said duct means to adjacent said intake means, and a water jacket for circulating coolant therethrough, said heat responsive means extending into said jacket, said heat responsive means comprising a member normally spaced from said valve and said member being operable to compressively engage and open said valve at said high temperature.

4. Apparatus for preventing an internal combustion engine from overheating, the engine including an engine air intake and an engine exhaust, said apparatus comprising air intake means connected to supply fresh air to said engine air intake, an exhaust system adapted to be connected to said exhaust and to discharge exhaust gas from said engine, duct means connected between said air intake means and exhaust system, a normally closed valve mounted in said duct means, and heat responsive means adapted to be mounted on said engine and to respond to a predetermined excessively high temperature of said engine, said heat responsive means being operatively coupled to open said valve only at said excessively high temperature, whereby a substantial portion of the exhaust gas is fed back from said exhaust system, through said duct means to said air intake means, sufficient to cause the engine to falter.

5. Apparatus for preventing an internal combustion engine from overheating, the engine including an engine air intake and an engine exhaust, said apparatus comprising air intake means connected to supply fresh air to said engine air intake, an exhaust system adapted to be connected to said exhaust and to discharge exhaust gas from said engine, duct means connected between said air intake means and exhaust system, a normally closed valve mounted in said duct means, and heat responsive means adapted to be mounted on said engine and to respond to a predetermined excessively high temperature of said engine, said heat responsive means being operatively coupled to open said valve at said high temperature, whereby at least a portion of the exhaust gas is fed back from said exhaust system, through said duct means to said air intake means, said exhaust system comprising a first duct having one end adapted to be connected to said engine, a water box connected to the other end of said first duct, and a second duct opening in said box at a level below said other end of the first duct, said second duct extending upwardly and out of said box, said box being adapted to normally maintain water at least up to said level, said duct means opening into said box above said level.

6. Apparatus according to claim 5, and further comprising a water jacket provided on said engine to circulate coolant therethrough, said heat responsive means extending into said jacket, said heat responsive means comprising a member normally spaced from said valve and said member being operable to compressively engage and open said valve at said high temperature.

7. An engine including apparatus for preventing the engine from overheating, said engine comprising an engine air intake, an engine exhaust, air intake means connected to supply fresh air to said engine air intake, an exhaust system connected to said exhaust and to discharge exhaust gas from said engine, duct means connected between said air intake means and exhaust system, a normally closed valve mounted in said duct means, and heat responsive means mounted on said engine and responsive to a predetermined excessively high temperature of said engine, said heat responsive means being operatively coupled to open said valve only at said excessively high temperature, whereby a substantial portion of the exhaust gas is fed back from said exhaust system, through said duct means to said air intake means, sufficient to cause the engine to falter.

8. An engine including apparatus for preventing the engine from overheating, said engine comprising an engine air intake, an engine exhaust, air intake means connected to supply fresh air to said engine air intake, an exhaust system connected to said exhaust and to discharge exhaust gas from said engine, duct means connected between said air intake means and exhaust system, a normally closed valve mounted in said duct means, and heat responsive means mounted on said engine and responsive to a predetermined excessively high temperature of said engine, said heat responsive means being operatively coupled to open said valve at said high temperature, whereby at least a portion of the exhaust gas is fed back from said exhaust system, through said duct means to said air intake means, said exhaust system comprising a first duct having one end connected to said engine, a water box connected to the other end of said first duct, and a second duct opening in said box at a level below said other end of the first duct, said second duct extending upwardly and out of said box, said box being adapted to normally maintain water at least up to said level, said duct means opening into said box above said level.

9. An engine according to claim 8, and further comprising a water jacket for circulating coolant therethrough, said heat responsive means extending into said jacket, said heat responsive means comprising a member normally spaced from said valve and said member being operable to compressively engage and open said valve at said high temperature.

10. A boat comprising a hull, said hull forming an enclosed engine compartment, a water-cooled internal combustion engine mounted in said compartment, an air intake means for supplying fresh air to said engine, an exhaust system connected to said engine and extending out of said compartment to discharge exhaust gas from said engine, duct means connected between said exhaust system and adjacent said air intake means, a normally closed valve provided in said duct means, and heat responsive means provided on said engine and connected to open said valve only in response to a predetermined excessively high temperature of said engine, whereby a substantial portion of the gas is fed back through said duct means to adjacent said intake means, sufficient to cause the engine to falter.

11. A boat comprising a hull, said hull forming an enclosed engine compartment, a water-cooled internal combustion engine mounted in said compartment, an air intake means for supplying fresh air to said engine, an exhaust system connected to said engine and extending out of said compartment to discharge exhaust gas from said engine, duct means connected between said exhaust system and adjacent said air intake means, a normally closed valve provided in said duct means, and heat responsive means provided on said engine and connected to open said valve in response to a predetermined excessively high temperature of said engine, whereby at least a portion of the gas is fed back through said duct means to adjacent said intake means, said exhaust system including a first duct having one end connected to said engine, a water box connected to the other end of said first duct, and a second duct opening in said box at a level below said other end of the first duct, said second duct extending upwardly and out of said box, said box being adapted to normally maintain water at least up to said level, said duct means opening into said box above said level.

12. Apparatus according to claim 11, and further comprising a water jacket for circulating coolant therethrough, said heat responsive means extending into said jacket, said heat responsive means comprising a member normally spaced from said valve and said member being operable to compressively engage and open said valve at said high temperature.

* * * * *